United States Patent [19]

Nakamura

[11] 3,956,611

[45] May 11, 1976

[54] HIGH PRESSURE RADIANT ENERGY IMAGE FURNACE

[75] Inventor: Yoshihiko Nakamura, Kawasaki, Japan

[73] Assignee: Ushio Electric Inc., Tokyo, Japan

[22] Filed: Dec. 17, 1973

[21] Appl. No.: 425,144

[52] U.S. Cl. ..... 219/349; 13/31; 219/354; 219/405; 219/411; 266/207

[51] Int. Cl.[2] ..... H05B 1/00

[58] Field of Search ..... 219/349, 352, 354, 343, 219/347, 383, 377, 405, 411; 432/255, 266, 205; 13/31

[56] References Cited

UNITED STATES PATENTS

| | | | |
|---|---|---|---|
| 931,945 | 8/1909 | Mehner | 219/349 UX |
| 1,326,794 | 12/1919 | Simding-Larsen | 13/31 |
| 2,543,053 | 2/1951 | Parker | 219/349 UX |
| 2,543,053 | 2/1951 | Parker | 219/349 |
| 2,707,719 | 5/1955 | Liebowitz | 13/31 |
| 2,834,590 | 5/1958 | Pugh | 432/255 X |
| 3,001,055 | 9/1961 | Lozier et al. | 219/349 |
| 3,053,639 | 9/1962 | Dolloff | 219/349 UX |
| 3,427,435 | 2/1969 | Webb | 219/349 |
| 3,603,766 | 9/1971 | Kino et al. | 219/349 |
| 3,623,712 | 11/1971 | McNeilly | 219/349 UX |
| 3,761,677 | 9/1973 | Mizutani et al. | 219/354 X |
| 3,805,019 | 4/1974 | Gorishek | 219/354 X |

FOREIGN PATENTS OR APPLICATIONS

| | | | |
|---|---|---|---|
| 484,199 | 4/1938 | United Kingdom | 219/349 |
| 1,061,592 | 11/1953 | France | 219/349 |

*Primary Examiner*—A. Bartis

*Attorney, Agent, or Firm*—Stevens, Davis, Miller & Mosher

[57] ABSTRACT

A high pressure radiant energy image furnace includes a radiant heat source, such as a Xenon short arc lamp or a halogen incandescent lamp, and an optical system for concentrating the radiant energy from the source on a sample enclosed in a thin wall transparent sample vessel. A closed high pressure vessel resistant to more than 10 atmospheres encloses the heat source as well as the optical system, sample and the sample vessel. A first high pressure gas source communicates with the high pressure vessel and a second high pressure gas source communicates with the sample vessel. The sample in the sample vessel is subjected to a gas pressure of more than 10 atmospheres and the gas pressures in the high pressure vessel and the sample vessel are substantially the same whereby pressure stresses the sample vessel created by differences in internal and external gas pressure are eliminated and the sample safety heated.

2 Claims, 3 Drawing Figures

HIGH PRESSURE RADIANT ENERGY IMAGE FURNACE

BACKGROUND OF THE INVENTION

The present invention relates to an arc-image furnace for heating a sample such as many kinds of heat resistant materials etc. at elevated temperature and more particularly relates to a high pressure arc-image furnace for heating the sample optically at several hundreds to about 4000°C and melting the same under a high pressure of 10 to several hundred atmospheres.

The heating apparatus of the present invention is characterized in that a heat source such as a lamp, an optical system and a sample to be heated are enclosed in a vessel which can withstand a high pressure of more than ten atmospheres, and the image of said lamp is projected to said sample through said optical system.

An arc-image furnace using a discharge lamp containing rare gas as a heat source thereof has hitherto been employed and is capable of being used continuously for several hundreds hours with a capacity of 30 KW because of development of the Xenon short-arc lamp of the cooled electrode type. Such arc lamp is expected to be used instead of the conventional carbonarc as a heat source of the furnace for heating heat resistant materials at several hundreds to about 4000°C and melting the same.

However, almost all elements or compounds are evaporated rapidly, boiled or sublimated after they are melted at elevated temperature under subatmospheric or atmospheric pressure. Accordingly, there are not many applications of said arc-image furnace for heating such materials in spite of the fact that high temperature can be obtained by such furnace. Especially, there are few applications of the arc-image furnace in the case of more than 1,500°C under atmospheric pressure or more than 2,000°C under less than 10 atmospheres. It has hitherto been proposed that such furnace can be utilized with advantages for controlling the consistency of a small quantity of contamination of a semi-conductor etc. However, such furnace has not yet been used practically because of the evaporation, boiling, or sublimation of the sample or the contamination.

FIG. 1 shows a conventional heating apparatus. As shown in FIG. 1, in said heating apparatus a sample 1 and supporting means 2 for said sample 1 are enclosed in a vessel 3 containing gases of predetermined pressure and made of heat resistant transparent material such as transparent fused silica etc. A paraboloid mirror 7 for reflecting and concentrating short-arc 6 produced between electrodes 5, 5 is supported in the atmosphere. 9 designates an electric circuit for controlling arc current, 10 a gas source, 11 a valve of the gas source 10, 12 a manometer, 13 a transparent plate of silica, 14 a mirror, 15 a monitor such as an industrial television etc., and 25 a passage of high pressure gas.

In order to heat a sample under about 10 atmospheres by a lamp of a capacity of less than 30 KW, it is necessary to determine suitably the thickness of the wall and the inner diameter of said heat resistant transparent vessel 3 because the temperature and pressure at the inside of the vessel 3 are higher than that at the outside and there is a risk of explosion. The factor of safety of the vessel 3 under the static pressure is usually determined as 5. In order to use the vessel 3 under about 100 atmospheres with the factor of safety under the static pressure of 5, the thickness of the wall of vessel 3 must be determined as at least 40mm in case the inner diameter thereof is 80mm. In practice, the factor of safety becomes zero because of the vessel 3 being overheated partially by the high density light beam projected to the sample 1 positioned at the central portion of the vessel 3, the convection gas of high temperature emittted from the sample 1 heated at several thousands °C and the thermal stress generated in the material of vessel 3 due to the large thickness thereof. Accordingly, the arc-image furnace as shown in FIG. 1 has not yet been used under a high pressure 10 to several hundred atmospheres.

SUMMARY OF THE INVENTION

An object of the present invention is to provide a heating apparatus in which a lamp as a heat source, an optical system and a sample are enclosed in a high pressure vessel.

Another object of the present invention is to provide a heating apparatus wherein a lamp as a heat source, an optical system, and a sample enclosed in an air-tight vessel are enclosed in a high pressure vessel.

The present invention includes a heat source, an optical system for concentrating radiant energy from the heat source on the sample to be heated, a sample vessel enclosing the sample, a high pressure vessel resistible to more than 10 atmospheres and enclosing the heat source, optical system, sample and sample vessel, and first and second high pressure gas sources communicating, respectively, with the high pressure vessel and sample vessel wherein the sample is safely heated to a pressure of more than 10 atmospheres and the gas pressures in the high pressure and sample vessels are substantially the same.

BRIEF DESCRIPTION OF THE DRAWING

Other objects and advantages of this invention will become apparent from consideration of the following description when taken in conjunction with the accompanying drawings, in which.

DESCRIPTION OF THE PREFERRED EMBODIMENTS

Figure 2:
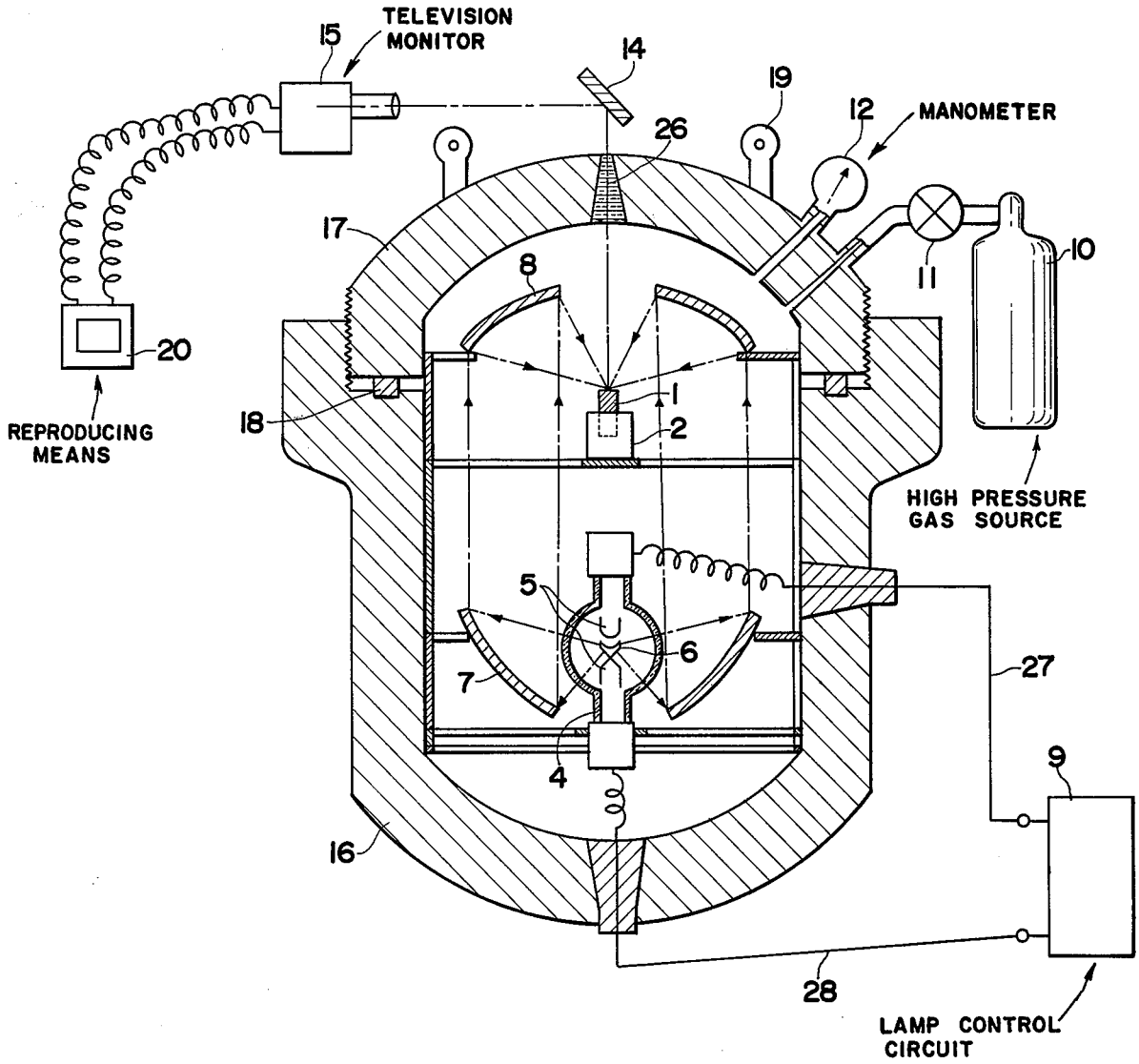
FIG. 2 is a longitudinal sectional view of a heating apparatus of one embodiment of the present invention for heating a sample at elevated temperature under about 10 to several hundreds atmospheres.

In a heating apparatus of the present invention, as shown in FIG. 2, a sample 1, a sample holding means 2, collecting mirrors 7, 8 and a lamp 4 are positioned in a high pressure metal vessel 16 resistible to a pressure of more than 10 atmospheres.

Figure 1:
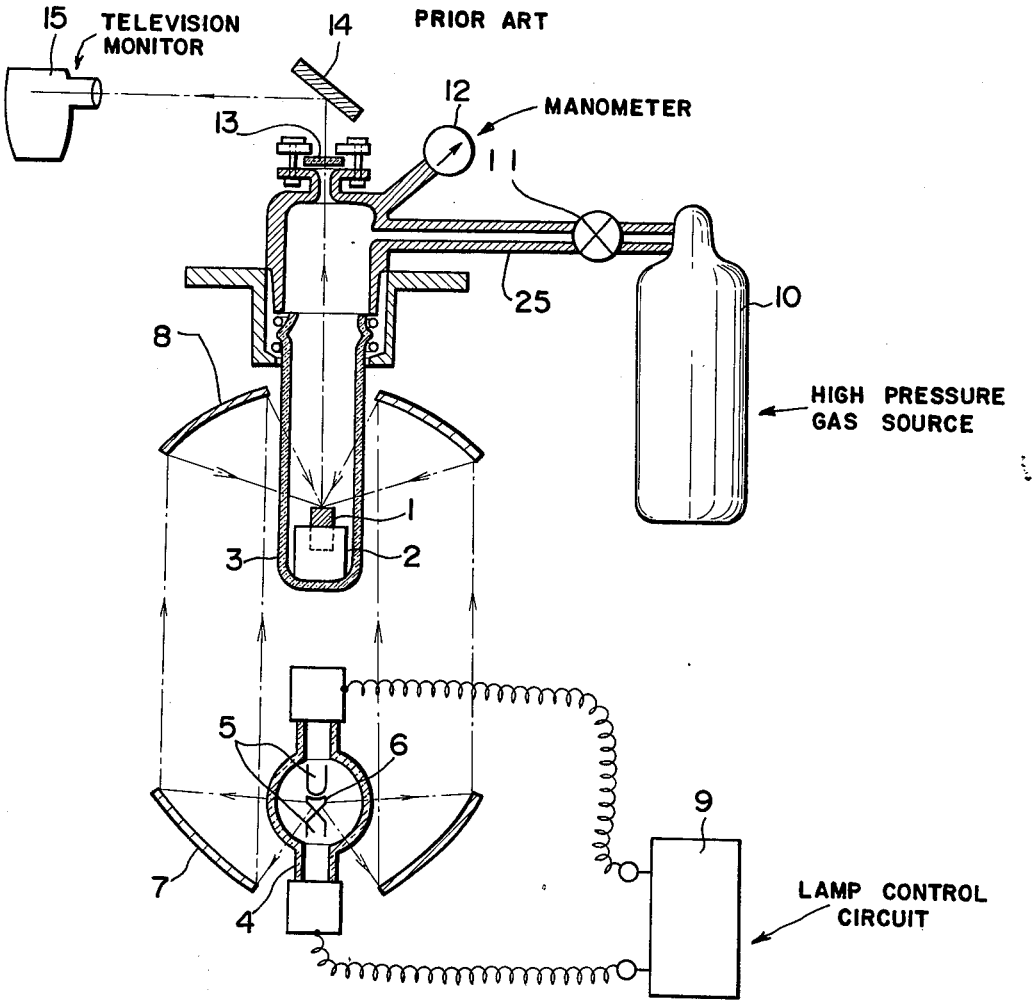
FIG. 1 is a longitudinal sectional view of a conventional light collecting heating apparatus in which the arc of a short-arc discharge lamp containing rare gas is concentrated by a pair of mirrors each having a paraboloid for heating a sample under a pressure of less than about 10 atmospheres.

The other parts of the apparatus which are similar to corresponding parts of apparatus shown in FIG. 1 have been given corresponding reference numerals and need not be further redescribed.

17 designates a lid for said high pressure metal vessel 16, 18 a gasket, 19 a lid suspending member, and 20 a reproducing means connected to a monitor 15.

In the heating apparatus according to the present invention, the sample 1 positioned at the focus point or in the vicinity thereto of the paraboloid mirror 8 is heated at several hundreds to about 4000°C and melted when the energy emitted from short-arc 6 of high output short-arc discharge lamp 4 positioned at the focus point or in the vicinity thereto of the paraboloid mirror 7 is directed to said sample 1 by said mirrors 7, 8 through an ambient of air, nitrogen, argon etc. of 10 to several hundreds atmospheres in the high pressure metal vessel 16. The state of heated and melted sample 1 can be observed by the monitor 15 through a window 26 provided on the top portion of the apparatus and a mirror 14. According to the present invention, the sample 1 can be treated at elevated temperature of 2,000°–4,000°C while preventing the evaporation and spattering of the sample because the pressure in the high pressure vessel 16 can be elevated to the maximum limit in pressure of the vessel and lamp. In this case, if a Xenon short-arc lamp is used as the heat source there is no fear such that the heat source is destroyed because such lamp can withstand several hundreds ambient atmospheres. Filament light of a halogen incandescent lamp can also be utilized as the heat source. Power supply cables 27, 28 for the above heat source are mounted air-tightly passing through the wall of the vessel 16. The optical system, lamp for the heat source and sample are supported on the inner wall of the vessel 16 or the lid 17 by a suitable supporting means.

Figure 3:
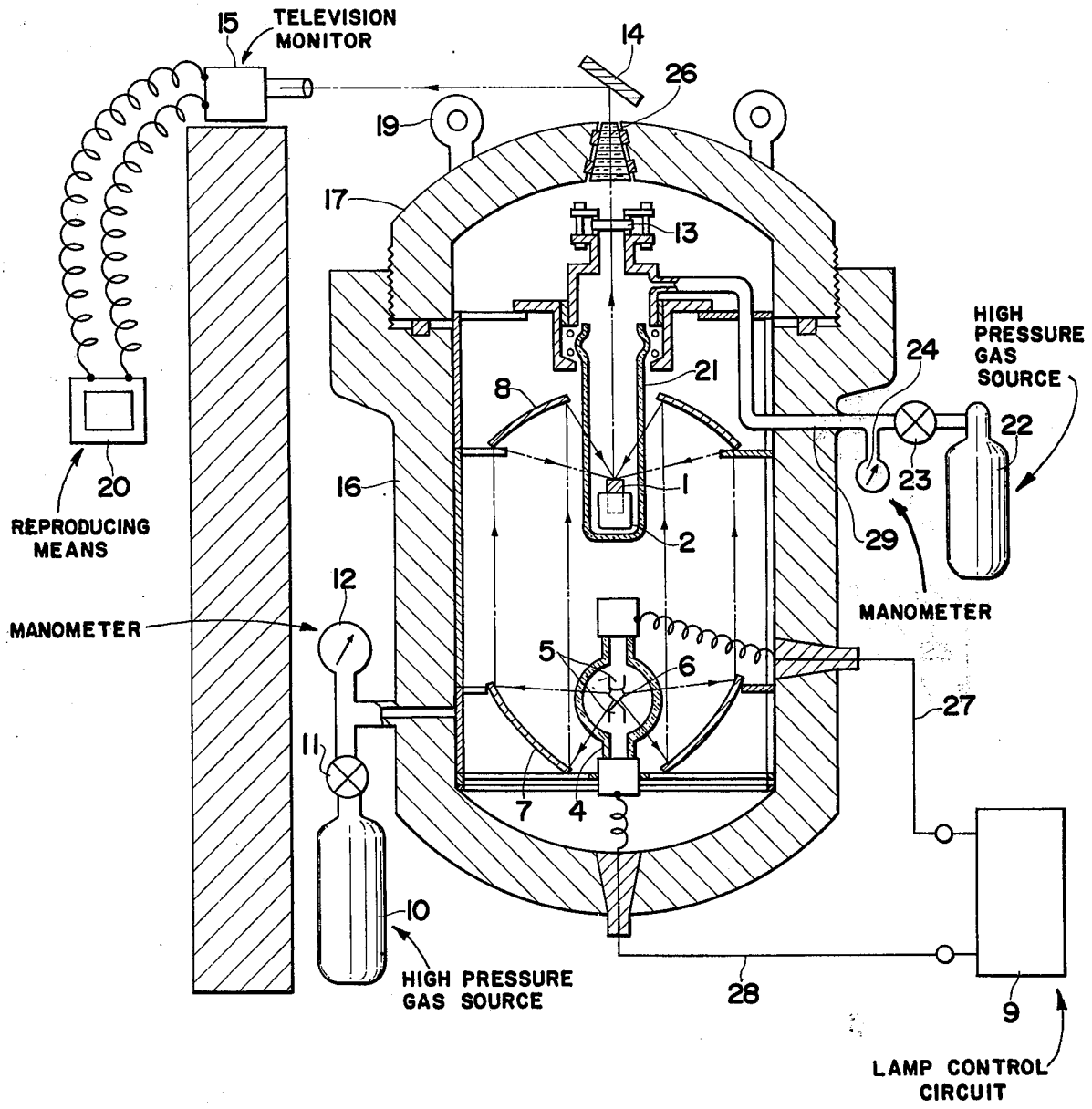
FIG. 3 is a longitudinal sectional view of the other embodiment of the present invention.

FIG. 3 shows the other embodiment of the present invention. In this embodiment, the sample 1 is separated from the ambient gas in the vessel 16 in enclosng the sample by an air-tight vessel 21 so as to apply a suitable gas at a suitable pressure to a sample 1 in consideration of the chemical and/or physical properties of the sample. In this case, the pressure in the vessel 21 can be increased to, for example, more than 100 atmospheres because no force is applied to the vessel 21 if the pressure in the vessel 16 is increased to the same pressure as that in the vessel 21. Therefore, a thin wall vessel of silica can be used as the vessel 21. This results in the preferable heating of the sample at higher temperature to be performed.

Said vessel 21 is made of transparent material of silica, for example, and supported on the inner surface of the vessel 16 or the lid 17 by a suitable supporting means. 22 designates a gas source of a predetermined gas supplying the vessel 21, 23 a valve, 24 a manometer, and 29 a passage passing through the wall of the vessel 16 for said gas supplied into the vessel 21.

As stated above, in the present invention, not only the sample can be treated thermally at elevated temperature of several thousands °C under several hundreds atmospheres, but also the chemical and/or properties physical of the sample which is liable to evaporate at the elevated temperature can be examined at elevated temperature while suppressing the vaporization and/or enclosing the sample in a suitable gas.

What I claim is:

1. A heating apparatus comprising a heat source including the arc of a Xenon short-arc lamp, an optical system for concentrating the radiant energy from said heat source on a sample to be heated, a thin wall sample vessel transparent to the radiant energy from said heat source and enclosing said sample air-tightly therein, a high pressure vessel resistible to more than 10 atmospheres and enclosing said heat source, said optical system, said sample and said sample vessel therein, a power supply cable passing air-tightly through the wall of said high pressure vessel for said heat source, a first high pressure gas source communicating with said high pressure vessel, and a second high pressure gas source communicating with said sample vessel, the sample in said sample vessel being subjected to a pressure of more than 10 atmospheres and the gas pressures in said high pressure vessel and said sample vessel being substantially the same, whereby pressure stresses on the sample vessel created by any difference in gas pressure inside and outside of the sample vessel are eliminated and the sample is safely heated.

2. A heating apparatus comprising a heat source including a radiant filament of a halogen incandescent lamp, an optical system for concentrating the radiant energy from said heat source on a sample to be heated, a thin wall sample vessel transparent to the radiant energy from said heat source and enclosing said sample air-tightly therein, a high pressure vessel resistible to more than 10 atmospheres and enclosing said heat source, said optical system, said sample and said sample vessel therein, a power supply cable passing air-tightly through the wall of said high pressure vessel for said heat source, a first high pressure gas source communicating with said high pressure vessel, and a second high pressure gas source communicating with said sample vessel, the sample in said sample vessel being subjected to a pressure of more than 10 atmospheres and the gas pressures in said high pressure vessel and said sample vessel being substantially the same, whereby pressure stresses on the sample vessel created by any difference in gas pressure inside and outside of the sample vessel are eliminated and the sample is safely heated.

* * * * *